United States Patent [19]

Sasaki et al.

[11] 4,205,923

[45] Jun. 3, 1980

[54] INK RIBBON FEED MECHANISM

[75] Inventors: Masao Sasaki; Yoshihisa Fukurohata, both of Tokyo, Japan

[73] Assignee: Oki Electric Industry Co., Ltd., Tokyo, Japan

[21] Appl. No.: 885,679

[22] Filed: Mar. 13, 1978

[51] Int. Cl.[2] ..... B41J 33/44

[52] U.S. Cl. ..... 400/220.1; 400/219.5; 400/234

[58] Field of Search ..... 400/219.5, 220, 220.1, 400/220.2, 234, 236.1; 101/336

[56] References Cited

U.S. PATENT DOCUMENTS

| | | | |
|---|---|---|---|
| 917,803 | 4/1909 | Scott | 400/220.1 X |
| 1,082,774 | 12/1913 | Sohm | 400/220.1 |
| 1,198,638 | 9/1916 | Kurowski | 400/234 X |
| 2,090,811 | 8/1937 | Salmon | 400/220.1 X |
| 2,902,136 | 9/1959 | Whippo | 400/220.1 X |
| 2,906,203 | 9/1959 | Grosse | 400/220 X |
| 3,184,027 | 5/1965 | Howard | 400/220.1 X |
| 3,542,183 | 11/1970 | Stiffler | 400/220.1 X |
| 3,633,506 | 1/1972 | Mumma et al. | 400/220 X |
| 3,786,906 | 1/1974 | Okabe | 400/220.1 X |
| 3,910,399 | 10/1975 | Shimodaira | 400/220.1 X |

*Primary Examiner*—Ernest T. Wright, Jr.
*Attorney, Agent, or Firm*—Peter L. Berger

[57] ABSTRACT

A mechanism for feeding an ink ribbon comprises a pair of ratchet wheels for taking up the ink ribbon, a feed pawl for rendering an intermittent movement to said ratchet wheels, a lever for preventing the backward movement of said ratchet wheels, a reverse mechanism for said ink ribbon, wherein a stopper which engages or disengages with said supply ratchet wheel in response to the movement of said lever is provided, thereby, through preventing the slack of the ink ribbon which occurs when the ink ribbon is taken up, the feeding of the ink ribbon is stabilized and the printing quality is improved.

8 Claims, 5 Drawing Figures

INK RIBBON FEED MECHANISM

BACKGROUND OF THE INVENTION

A. Field of the Invention

The present invention relates to an ink ribbon of a high-speed printer used for data processing of computers, or more particularly, to a mechanism for preventing slack in an ink ribbon. A stopper is provided which engages or disengages with a lever for preventing the backward movement of the ratchet wheel on which a spool of the ink ribbon is mounted . This prevents slack of the ink ribbon when the ink ribbon is fed, stablizes the feeding of the ink ribbon and improves the printing quality.

B. Description of the Prior Art

In an ink ribbon feed mechanism of a high-speed printer, the ink ribbon is stretched between a pair of ratchet wheels on which a spool of the ink ribbon is mounted, and the ink ribbon is fed when needed for printing. In the prior art mechanism, a back-stopper for preventing backward movement of the ink ribbon is provided only at the take-up side of the ratchet wheel. Therefore, at the supply side of the ink ribbon, the slack of the ink ribbon occurs when the ink ribbon is fed or reversed on account of the friction between the ink ribbon and the printing paper as well as the printing position. The printing quality correspondingly deteriorates and also the life of the ink ribbon is reduced. To prevent this slack, a high degree of friction is applied to the supply side of the ratchet wheel. But due to the friction, the necessary power input for turning the above-said ratchet wheel is required to be increased, and the mechanism for averaging the friction is complicated.

SUMMARY OF THE INVENTION

The present invention contemplates linking a stopper which engages or disengages with a supply ratchet wheel with a lever for preventing the backward movement of said ratchet wheel. Said lever is pivotally supported by a shaft situated at the upper center thereof, and at the upper side thereof, backstoppers for preventing the backward movement of the ratchet wheel are provided. At the lower side thereof, the above-said stoppers are provided. By these provisions, the slack of the ink ribbon which occurs when it is fed or reversed is prevented in order to stabilize the feeding of the ink ribbon and to improve printing quality. The above and further objects and novel features of the invention will more fully appear from the following detailed description when the same is read in connection with the accompanying drawing. It is to be expressly understood, however, that the drawing is for purpose of illustration only and is not intended as a definition of the invention.

DETAILED DESCRIPTION OF THE PREFERRED EMBODIMENT

Figure 1:
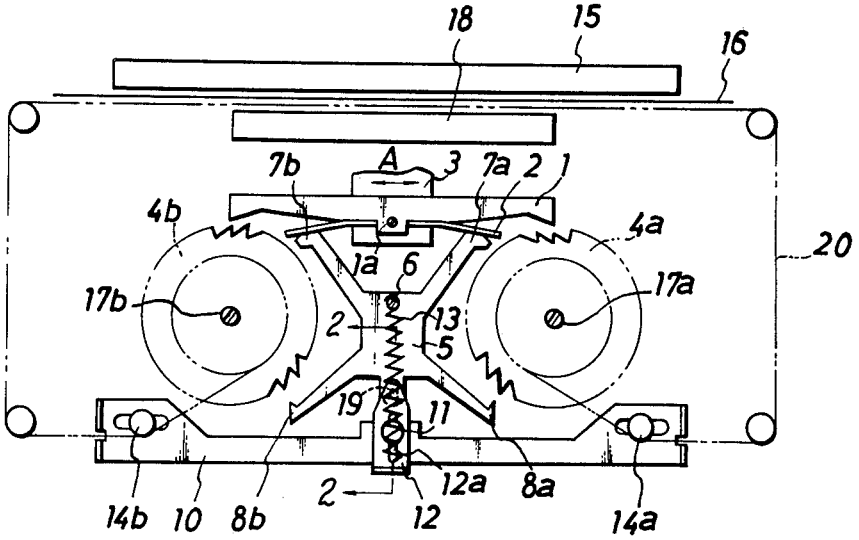
FIG. 1 is a plan view illustrative of an embodiment of an ink ribbon feed mechanism of the invention.
Figure 2:
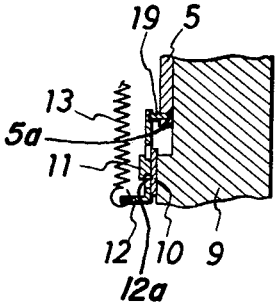
FIG. 2 is a partial cross-sectional view taken along line 2—2 of FIG. 1.

FIG. 1 is a plan view illustrative of the ink ribbon feed mechanism of the present invention, and FIG. 2 is a partial cross-sectional view of FIG. 1. In these FIGS., numeral 1 indicates a feed pawl pivotally supported by a shaft 1*a*, numeral 2 indicates a plate spring fixed to said feed pawl 1, numeral 3 indicates a plate for rendering a reciprocating movement to said feed pawl 1 as shown by an arrow A of FIG. 1. Plate 3 is reciprocated by a drive mechanism (not shown). Numerals 4*a*, 4*b* indicate ratchet wheels, numeral 5 indicates a lever which is pivotally supported by a shaft 6 at the upper center thereof, and back-stoppers 7*a*, 7*b*, and also stoppers 8*a*, 8*b* are, for example, are symmetrically provided at the upper end or the lower end thereof. Numeral 9 indicates a frame (see FIG. 2), numeral 10 indicates a change arm to which a guide 11 is fixed, numeral 12 indicates a detent lever in which an oblong hole 12*a* is bored, and the guide 11 of the change arm 10 is inserted in it. Numeral 13 indicates a detent spring stretched between the above-said shaft 6 and said detent lever 12. Numerals 14*a*, 14*b* indicate a guide of the above-said change arm 10, numeral 15 indicates a platen, numeral 16 indicates a printing paper, numerals 17*a*, 17*b* indicate a shaft of the above-said ratchet wheels 4*a*, 4*b*, numeral 18 indicates a printing mechanism, numeral 19 indicates a pin which is fixed to the other end of the above-said detent lever 12 and inserted into a hole 5*a* provided at the lower center of the lever 5, and the lever 5 is linked with the detent lever 12 by the pin 19. Numeral 20 indicates an ink ribbon.

Figure 3:
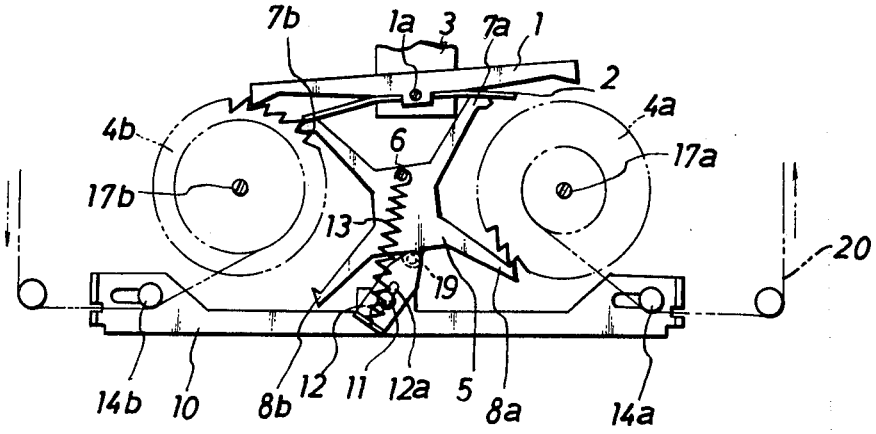
FIGS. 3, 4 and 5 are operational plan views of the ink ribbon feed mechanism.
Figure 4:
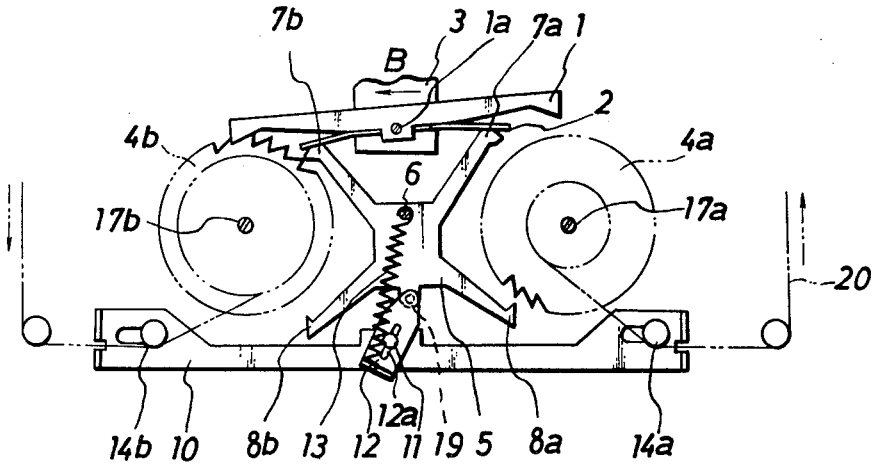
Figure 5:
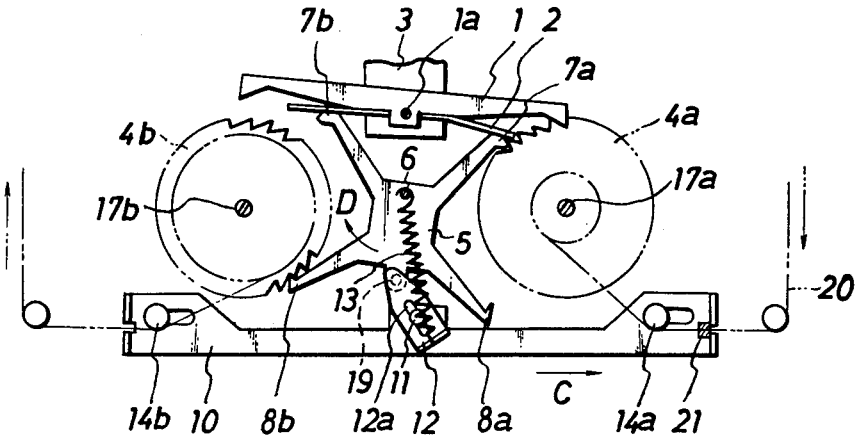

A distinctive feature of an ink ribbon feed mechanism of the invention is, for example in FIG. 3, the provision of the stopper 8*a* which engages or disengages with the ratchet wheel 4*a* on which the supply spool is mounted at the lever 5 for preventing the backward movement. The distance between said shaft 6 and stoppers 8*a*, 8*b* is greater than the distance between the shaft 6 and back-stoppers 7*a*, 7*b*. The stopper 8*a* is disengaged from the supply ratchet wheel 4*a* (see FIG. 4) when the back-stopper 7*b* is raised on the top of the saw-tooth of the take-up ratchet wheel 4*b* for counter clock-wise rotation. Referring to the plate spring 2 which is fixed to the feed pawl 1 and is in contact with the back-stoppers 7*a*, 7*b*, the amount of the deflection differs with each other on the right or left side of the shaft 1*a*, because of the difference of the distance between said feed pawl 1 and the back-stoppers 7*a*, 7*b*. Therefore, in the reverse movement of the ink ribbon 20, the feed pawl 1 snaps from the ratchet wheel 4*b*, formerly a take-up side onto the ratchet wheel 4*a*. In FIG. 5, numeral 21 indicates a grommet which is attached to the rear end of the ink ribbon 20.

The operation of the above-said ink ribbon feed mechanism is explained with reference to the operational plan view of FIGS. 3 through 5. In FIG. 3, the feed pawl 1 engages with the take-up ratchet wheel 4*b* and the back-stopper 7*b* with said ratchet wheel 4*b*, and the stopper 8*a* with the supply ratchet wheel 4*a*. Following is an explanation of how the take-up ratchet wheel 4*b* is driven one saw-tooth to the other with reference to FIGS. 3 and 4. By the transverse movement of the plate 3 as shown by an arrow B of FIG. 4, the feed pawl 1 moves to rotate the ratchet wheel 4*b* and the back-stopper 7*b* is lifted to the top of the saw-tooth of the ratchet wheel 4*b* as shown in FIG. 4 by the rotation. Then, the stopper 8*a* is removed from engagement with the ratchet wheel 4*a*, allowing the rotation of said ratchet wheel 4*a* via the ink ribbon 20. On further rotation of the ratchet wheel 4*b* by the feed pawl 1, the back-stopper 7b comes in engagement with the next saw-tooth of the ratchet wheel 4b and the stopper 8a moves to come in engagement with the ratchet wheel 4a. Thereby, the feed pawl 1 is restored as shown in FIG. 3 when the back-stopper 7b completely comes in engagement with the next saw-tooth of the ratchet wheel 4b. When the feed pawl 1 is restored, the back-stopper 7b engages with the take-up ratchet wheel 4b and also the stopper 8a engages with the supply ratchet wheel 4a, to prevent movement of the ink ribbon 20 which prevents slackening of the ink ribbon 20. The stopper 8a disengages with the ratchet wheel 4a only when the back-stopper 7b is lifted by the ratchet wheel 4b and the back-stopper 7b comes in engagement with the bottom of the saw-tooth of the ratchet wheel 4b. Therefore, due to this working together, the ink ribbon 20 cannot become slack at any time.

As described, the ink ribbon 20 is taken up by the ratchet wheel 4b in FIGS. 3 and 4, but in FIG. 5, the ink ribbon 20 is reversed to be taken up by the ratchet wheel 4a. A grommet 21 which is fixed at the rear end of the ink ribbon 20 of the ratchet wheel 4a side which was formerly a supply side moves the change arm 10 in a direction shown by an arrow C in response to the feeding of the ink ribbon 20. Then, the pin 19 which is fixed to the detent lever 12 and inserted into the hole 5a provided at one end of the lever 5 rotates said lever 5 in a direction shown by an arrow D in response to the action of the detent lever 12 and the detent spring 13. In this manner, contrasted with FIGS. 3 and 4, the back-stopper 7a engages with the ratchet wheel 4a. Moreover, on account of the difference of the amount of the deflection of the plate spring 2 as described, the feed pawl 1 snaps from the ratchet wheel 4b, formerly a take-up side, onto the ratchet wheel 4a. And then, the reciprocating movement of the plate 3 is transferred via the feed pawl 1 to the ratchet wheel 4a as an intermittent movement. The ratchet wheel 4a then becomes the take-up side to take up the ink ribbon 20 in the reverse direction.

As described above, the stopper which engages or disengages with the supply ratchet wheel in response to the movement of the back-stopper which is provided for preventing the backward movement of the take-up ratchet wheel is provided in the present invention and said stopper engages with the supply ratchet wheel to control the rotation of the spool when the ink ribbon is fed or reversed, thereby preventing the slack of the ink ribbon and the feeding of the ink ribbon can be stabilized.

While there have been shown and described and pointed out the fundamental novel features of the invention as applied to a preferred embodiment, it will be understood that the various omissions and substitutions and changes in the form and details of the mechanism illustrated and in its operation may be made by those skilled in the art without departing from the spirit of the invention.

What is claimed is:

1. In an ink ribbon feed mechanism comprising a first ratchet wheel serving to supply an ink ribbon and a second ratchet wheel serving to take-up said ink ribbon when said ink ribbon is moved in a first direction, a feed pawl operatively associated with said ratchet wheels and supplying an intermittent movement thereto to move said ink ribbon, and a lever for preventing backward movement of said second ratchet wheel, an improvement comprising a first stopper means operatively connected with said lever to engage said first ratchet wheel to prevent said first ratchet wheel from forward movement while said lever prevents backward movement of said second ratchet wheel.

2. In an ink ribbon feed mechanism of claim 1, wherein said feed pawl is engageable to reverse the rotation of said first and second ratchet wheels and said lever prevents backward movement of said first ratchet wheel, said improvement further comprising second stopper means operatively connected while said lever to engage said second ratchet wheel to prevent said second ratchet wheel from forward movement while said lever prevents backward movement of said first ratchet wheel.

3. The invention of claim 1, wherein said lever and said first stopper means comprises a unitary assembly.

4. The invention of claim 2, wherein said lever, said first stopper means and said second stopper means comprise a unitary assembly.

5. The invention of claim 4, wherein said unitary assembly comprises first spaced-apart legs located at an upper portion thereof projecting toward said second and said first ratchet wheels, respectively, and second spaced-apart legs located at a lower portion thereof projecting toward said second and said first ratchet wheels, respectively, said first stopper means being formed of one of said spaced-apart legs of said second spaced-apart legs projecting toward said first ratchet wheel and said second stopper means being formed of the other of said spaced-apart legs of said second spaced-apart legs projecting toward said second ratchet wheel.

6. The invention of claim 5, comprising a shaft connected to said unitary assembly about which said assembly rotates to effect its operation, said assembly comprising said first spaced-apart legs being located closer to said shaft than said spaced-apart second legs.

7. The invention of claim 1, comprising a plate spring cooperatively engaging said feed pawl with said lever and a detent spring cooperatively engaging said first stopper means against said first ratchet wheel.

8. The invention of claim 2, comprising a plate spring cooperatively engaging said feed pawl with said lever and a detent spring cooperatively engaging said first stopper means and said second stopper means against said first and second ratchet wheel, respectively.

* * * * *